US008973179B2

(12) United States Patent
Thwaites

(10) Patent No.: US 8,973,179 B2
(45) Date of Patent: Mar. 10, 2015

(54) PORTABLE CAMPING SINK

(76) Inventor: Danny F. Thwaites, Dover, DE (US)

( * ) Notice: Subject to any disclaimer, the term of this patent is extended or adjusted under 35 U.S.C. 154(b) by 300 days.

(21) Appl. No.: 13/586,986

(22) Filed: Aug. 16, 2012

(65) Prior Publication Data

US 2014/0047636 A1 Feb. 20, 2014

(51) Int. Cl.
*E03C 1/322* (2006.01)

(52) U.S. Cl.
USPC ..... 4/647

(58) Field of Classification Search
USPC ..... 4/619–660; 312/237
See application file for complete search history.

(56) References Cited

U.S. PATENT DOCUMENTS

| | | | | | |
|---|---|---|---|---|---|
| 602,494 | A | * | 4/1898 | Briggs | 4/626 |
| 1,358,937 | A | * | 11/1920 | Curliss | 4/626 |
| 2,594,938 | A | | 4/1952 | Leavitt | |
| 2,663,392 | A | | 12/1953 | Miller | |
| 3,915,529 | A | * | 10/1975 | Bernier | 312/237 |
| 5,301,376 | A | | 4/1994 | Herbert | |
| D382,632 | S | * | 8/1997 | Herms | D23/284 |
| 5,813,063 | A | * | 9/1998 | Watkins et al. | 4/626 |
| 5,881,404 | A | | 3/1999 | Knight | |
| 6,081,942 | A | | 7/2000 | Bellamy | |
| 6,328,131 | B1 | * | 12/2001 | Backus | 182/187 |
| 6,546,569 | B2 | | 4/2003 | Figueras | |
| 6,883,881 | B2 | | 4/2005 | Gauss | |
| 6,959,460 | B2 | | 11/2005 | Patterson | |
| 7,802,327 | B1 | * | 9/2010 | Moceri et al. | 4/625 |
| 7,901,018 | B2 | * | 3/2011 | Baughman | 312/240 |
| 2013/0254986 | A1 | * | 10/2013 | Nelson | 4/647 |

* cited by examiner

*Primary Examiner* — Huyen Le
*Assistant Examiner* — Christine Skubinna
(74) *Attorney, Agent, or Firm* — Norman E. Lehrer

(57) ABSTRACT

The portable camping sink includes a hollow rectangular housing with top, bottom, left, right and rear walls and an open front. A basin is hinged to the front of the bottom wall and is movable between a closed position where it closes the front and an operative position lying at a right angle to the front where it can function as a sink. Locks and straps maintain the basin in its inoperative or operative positions. A water container has a size and shape allowing it to be inserted into the housing and includes a spout overlying the basin when the basin is in its operative position. Racks or shelves are hinged to the housing sides. Straps allow the portable sink to be suspended from the trunk of a tree during use. Shoulder straps allow a person to carry the camping sink on his back.

6 Claims, 6 Drawing Sheets

PORTABLE CAMPING SINK

BACKGROUND OF THE INVENTION

The present invention is directed toward a portable camping sink and more particularly, toward such a sink that is easily transported and assembled and that can be supported on the trunk of a tree for use, thereby not requiring legs or similar support structure.

Camping in the woods has been a popular activity for generations. This is frequently done while participating in other activities such as hunting but many people enjoy camping solely for the experience of temporarily living in the outdoors.

There are, of course, many levels of camping depending on how rough or rustic the campers desire to experience. Some people own campers or similar vehicles that are essentially small traveling homes that include kitchens and toilets and other modern facilities. These vehicles can be self contained and/or can hook up to water and electric at commercial camp sites. Other commercial camp sites are available in many locations where campers can pitch tents but which have toilets and sinks available at central locations for use by the campers.

Diehard campers, however, prefer to be away from all such modern facilities and carry with them everything that they need. Although they wish to "rough it" they still wish to maintain adequate hygiene. In particular, if a clean, fresh water stream is not available, they still wish to have the ability to wash their hands and face and to wash dishes and other eating utensils. For such people, a number of portable sinks have been proposed over the years that are intended to provide at least these conveniences. Prior art portable camping sinks are shown, for example, in U.S. Pat. No. 2,594,938 to Leavitt; U.S. Pat. No. 2,663,392 to Miller and U.S. Pat. No. 5,301,376 to Herbert.

The above prior art camping sinks and others that may have been available, however, suffer from numerous deficiencies. All prior art sinks known to applicant include legs for supporting the sink on the ground or must be supported on a table or the like. None includes shoulder straps or the like for ease of carrying and most do not include auxiliary compartments or shelves for housing accessories or for assisting in the use of the sink. In essence, no prior art portable camping sink has been shown to be satisfactory.

There is, therefore, a need for a portable camping sink that is easy to transport and assemble at a camp site that does not require the use of a stand or of legs and which includes auxiliary compartments and shelves that make the use of the sink easy and convenient.

SUMMARY OF THE INVENTION

The present invention is designed to overcome the deficiencies of the prior art discussed above. It is an object of the present invention to provide a portable camping sink that is compact and can be easily carried.

It is another object of the present invention to provide a portable camping sink that can be easily set up for use at a camping site.

It is a still further object of the present invention to provide a portable camping sink that does not require a stand or legs and which can be easily attached to a tree trunk.

In accordance with the illustrative embodiments demonstrating features and advantages of the present invention, there is provided a portable camping sink that includes a hollow rectangularly shaped housing having a top wall, a bottom wall, left and right side walls, a rear wall and an open front. A sink basin is hinged to the front of the bottom wall and is movable between a closed position where it substantially closes the open front of the housing and an operative position where it is at an angle of approximately 90° to the plane of the open front where it can function as a conventional sink. Locks and straps are provided for maintaining the basin in either its inoperative or operative positions. A separate water container is provided that has a size and shape allowing it to be inserted into the housing. The container includes a spout that overlies the basin when the basin is in its operative position. Racks or shelves are hinged to either side of the housing. The portable sink includes straps that allow it to be suspended from the trunk of a tree during use. Shoulder straps attached to the bottom wall allow a person to carry the camping sink on his or her back.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
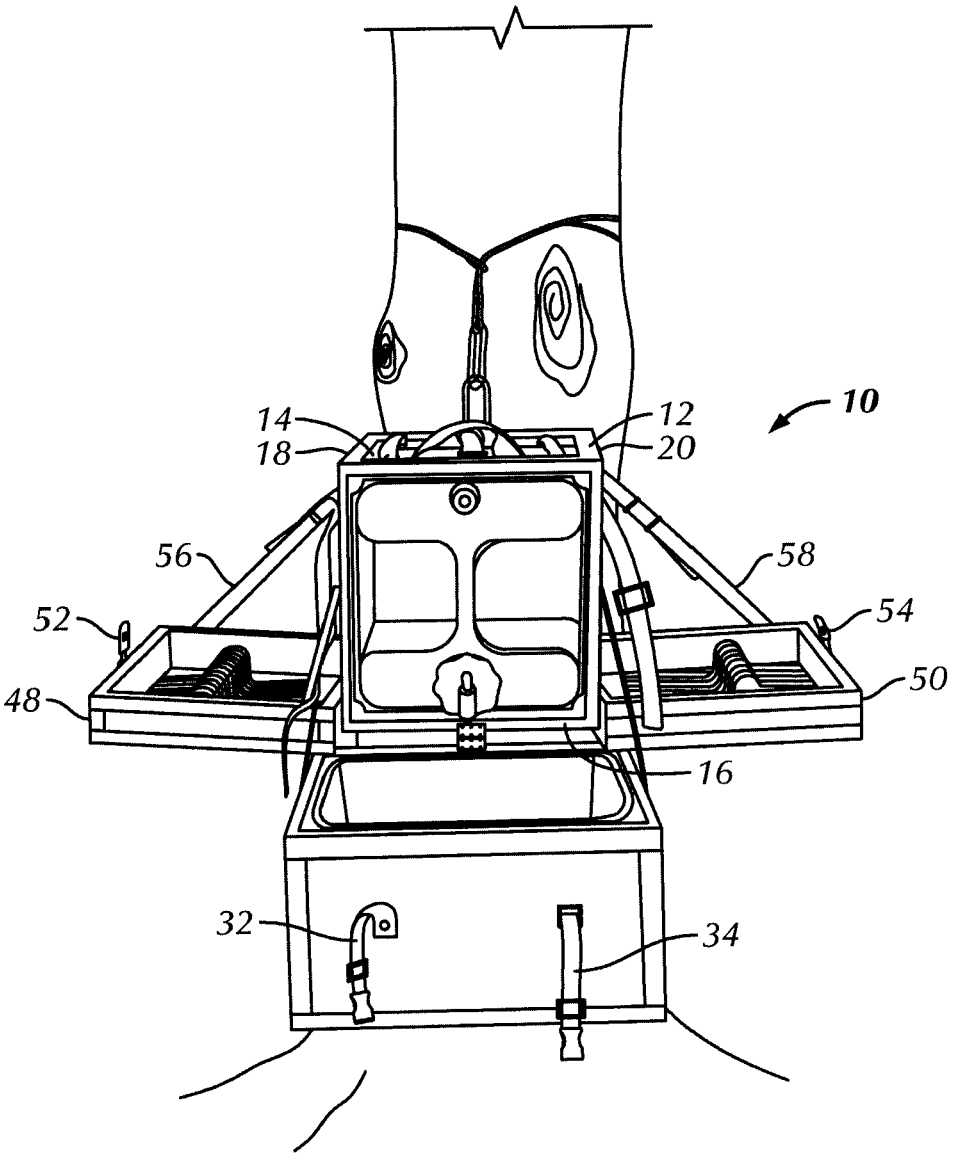
FIG. 1 is front perspective view of the portable camping sink of my invention and showing the same in its fully open and operational condition.

Referring now to the drawings in detail wherein like reference numerals have been used throughout the various figures to designate like elements, there is shown in FIGS. 1-6 a portable camping sink constructed in accordance with the principles of the present invention and designated generally as 10.

The portable camping sink 10 is comprised of several component parts including a substantially rectangularly shaped housing 12 having a top wall 14, a bottom wall 16, a left wall 18, a right wall 20 a rear wall 22, an open front and a substantially hollow interior 24. A sink basin 26 is supported in a second rectangularly shaped housing 28 that is hinged through the use of one or more hinges 30 to the front of the bottom wall 16 of the housing 12.

Figure 2:
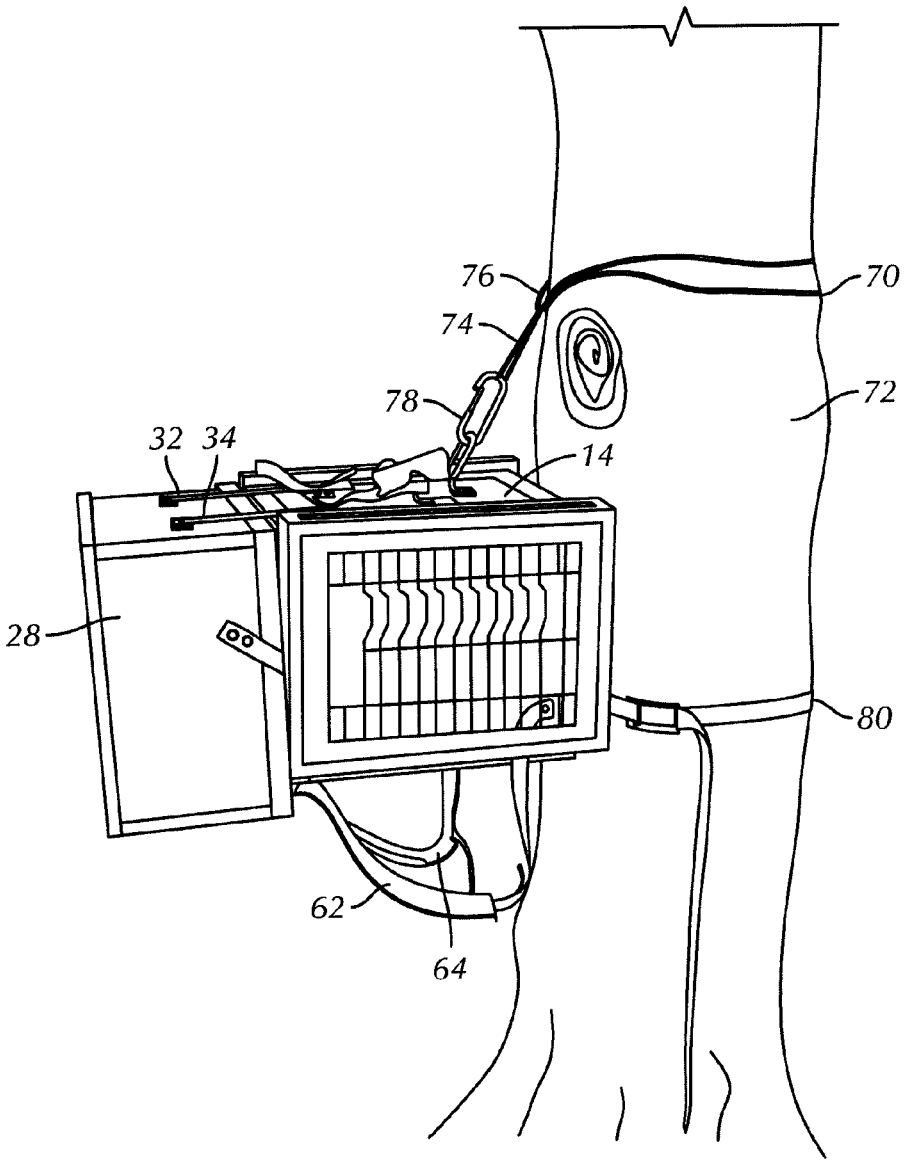
FIG. 2 is a right side perspective view of the portable camping sink in its closed condition but supported on a tree.
Figure 3:
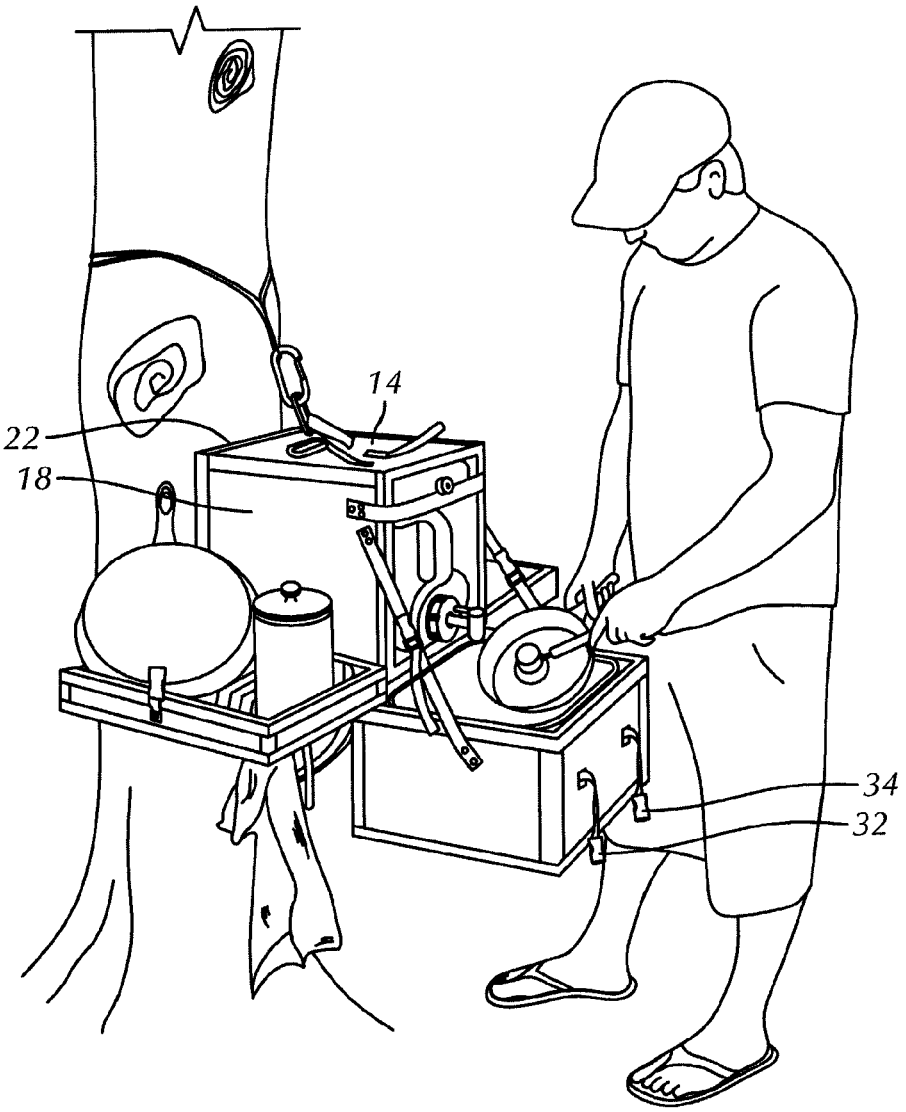
FIG. 3 is a left side perspective view of the invention showing the same being used by a camper.
Figure 4:
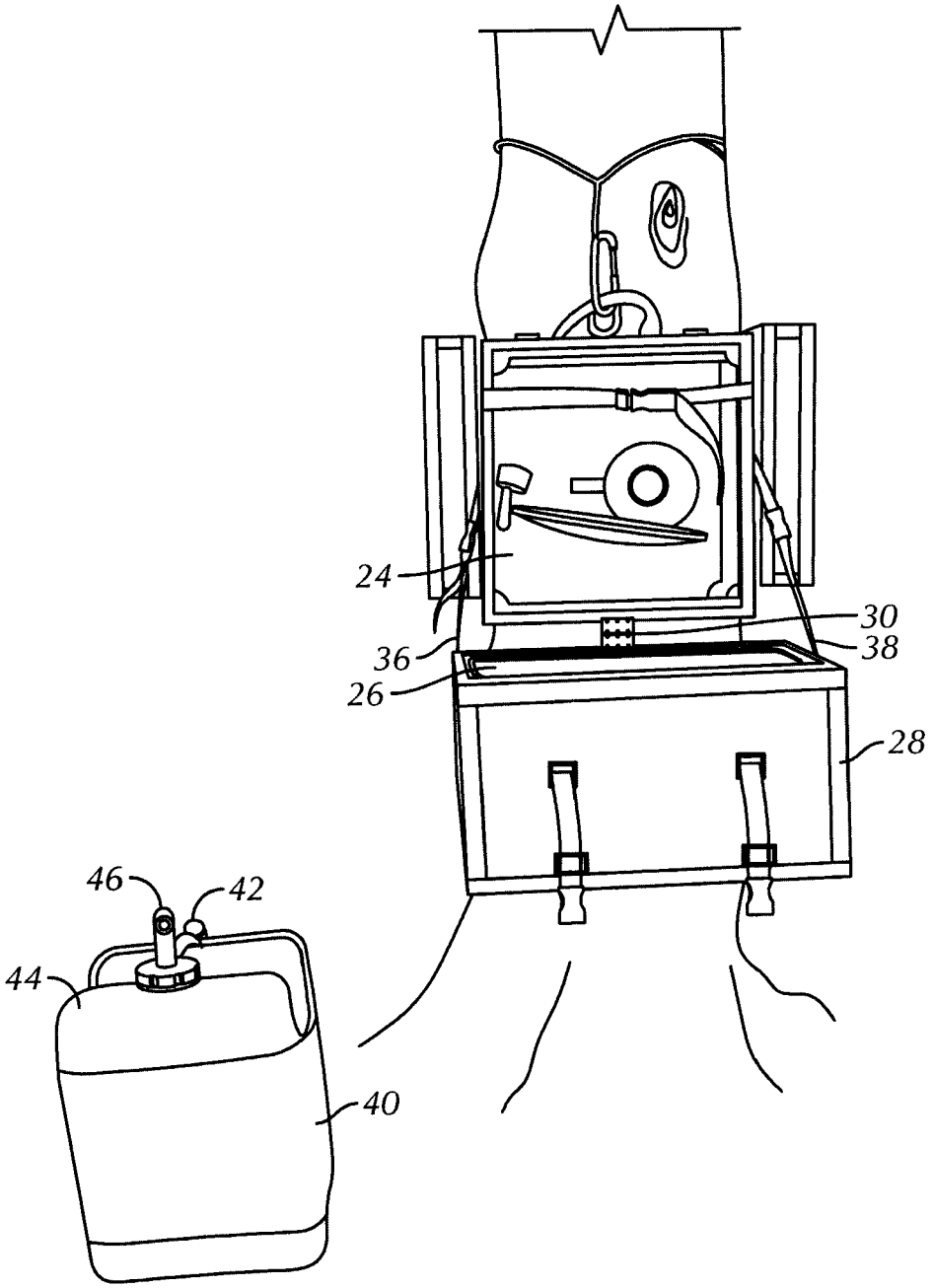
FIG. 4 is a front perspective view similar to FIG. 1 but showing the sink in a partially open condition.
Figure 5:
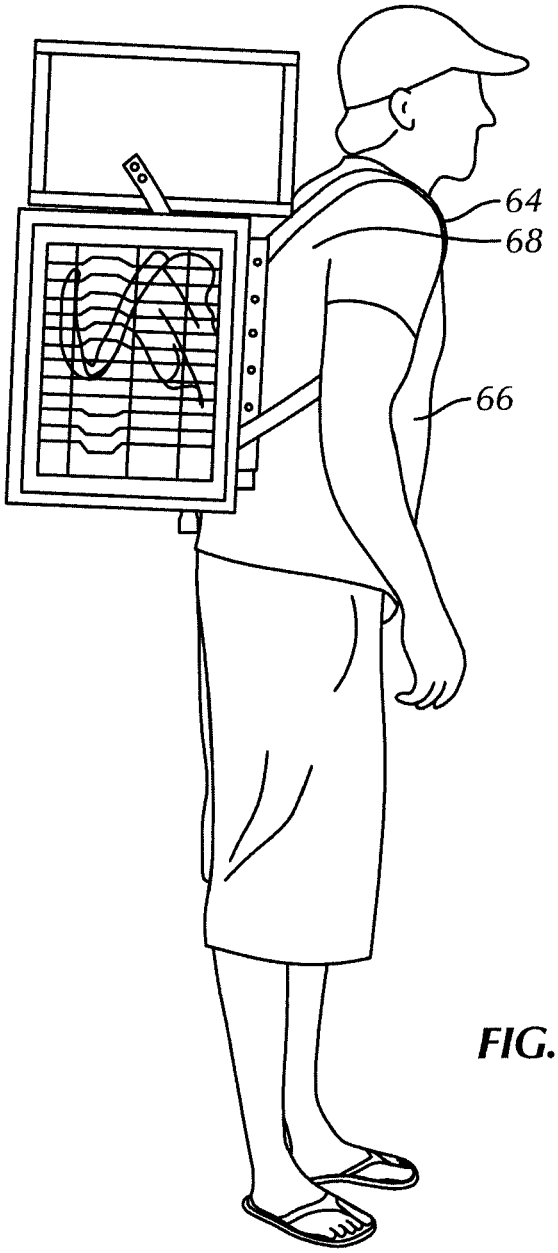
FIG. 5 is a side view of the portable camping sink being carried by a camper using shoulder straps secured to the sink.

The housing 28 along with the sink basin 26 is movable essentially between two positions. The first is an inoperative position, as shown in FIG. 2, where it substantially closes the front of the housing 12. The second position is an operative position, as shown in FIGS. 1, 3 and 4, where it is at essentially a 90° angle to the plane of the open front of the housing 12.

As shown best in FIG. 2, straps 32 and 34 extend between the housing 28 and the top wall 14 of the housing 12 to maintain the basin 26 in the inoperative position, when desired. Appropriate snaps, hooks or buckles or similar connectors are provided for attaching the straps 32 and 34 to the housings 12 and 28. This is, of course, by way of example only. Those skilled in the art will undoubtedly find numerous other means for maintaining the basin 26 in the inoperative position shown in FIG. 2.

Similarly, straps 36 and 38 that extend from the side walls 18 and 20 of the housing 12 to the sides of the housing 28 maintain the sink basin 26 in the operative position. Again, appropriate snaps, hooks, or buckles or the like are provided to attach the straps 36 and 38 to the housings 12 and 28. And, again, this is by way of example only as numerous other means can be provided for maintaining the sink basin 26 in its operative position while still allowing it to move between its operative and inoperative positions.

Figure 6:
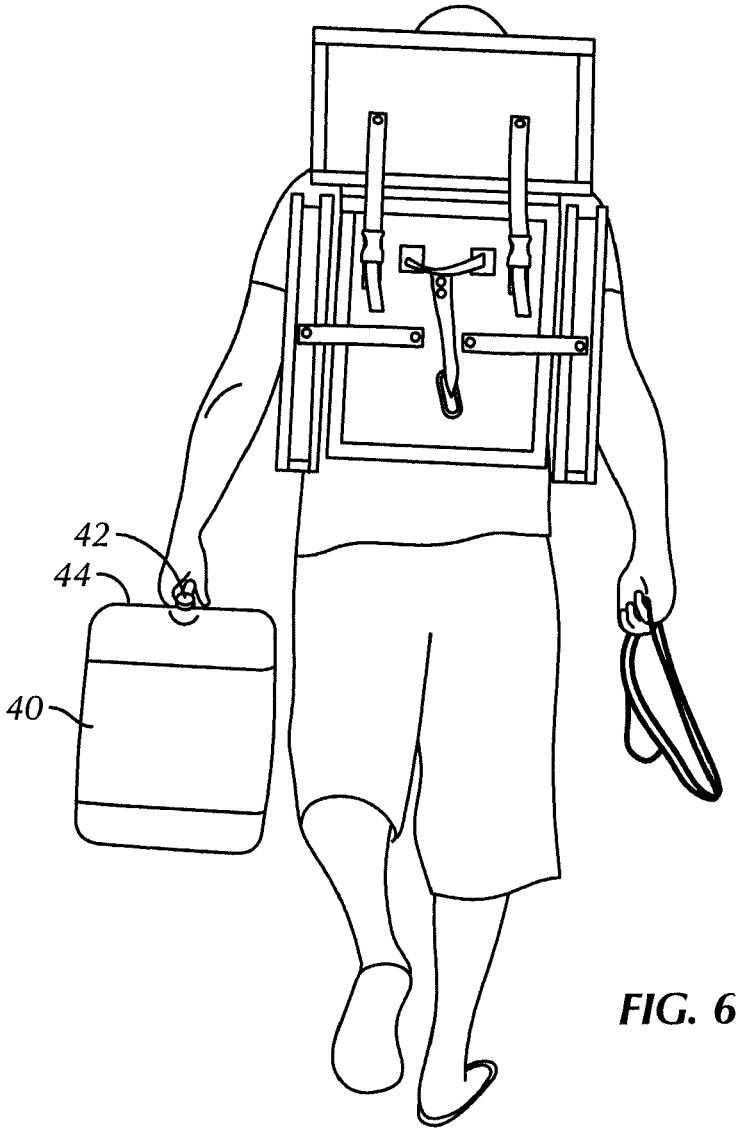
FIG. 6 is a rear view of the portable camping sink being carried by a camper.

The portable camping sink 10 does not have its own water supply or reservoir, per se. Rather, a separate rectangularly shaped plastic water container 40 is provided. The water container 40 may be a 5 or 7 gallon plastic container and is sized to fit within the hollow interior 24 of the housing 12. The water container 40 includes a handle 42 at the top 44 thereof for ease of carrying as shown in FIG. 6. The water container 40 also includes a spout in the form of a nozzle or spigot 46 adjacent one edge of the top 44 as shown in FIG. 4

As best shown in FIGS. 1 and 3, when the water container 40 is placed into the hollow interior 24 of the housing 12, the spout of the spigot 46 extends out slightly to be positioned over the sink basin 26. The spigot 46, of course, has an appropriate manually operated valve so that one can open and close the spigot to allow water to flow from the container 40 into the sink basin 26 when desired. While not shown, it should be readily apparent to those skilled in the art that the sink basin 26 may also be provided with an appropriate drain adjacent the bottom thereof to allow water in the basin to drain therefrom.

When the water container 40 is not in the hollow interior 24 of the housing 12, cooking utensils, dishes and the like can be stored therein. See FIG. 4. This is particularly useful space for holding these objects when the portable camping sink is being carried from place to place. Obviously, these items must be removed before inserting the water container 40 in place.

The portable camping sink 10 also includes a pair of side racks 48 and 50 hinged to the left and right side walls 18 and 20 respectively of the housing 12. The side racks 48 and 50 are hinged to the side walls 18 and 20 so as to be movable between an inoperative position as shown in FIG. 4 and an operative position as shown in FIGS. 1 and 3. In the inoperative position, straps or buckles or the like 52 and 54 cooperate with complimentary connectors on the top wall 14 of the housing 12 to maintain the side racks 48 and 50 in their inoperative position. Similarly, straps 56 and 58, extending between the housing 12 and the racks 48 and 50, respectively, maintain the racks in their operative positions as seen in FIGS. 1 and 3.

The racks 48 and 50 may be used for holding dishes or cooking utensils or the like before or after cleaning in the sink basin 26. For this reason, one or both of the racks may include a wire dish drainer 60 or substantially any other known dish or utensil holder or support. Furthermore, one or both of the racks 48 and 50 may be provided with an appropriate drain to allow water to drain therefrom.

For ease of carrying the portable camping sink 10, it is provided with a pair of shoulder straps 62 and 64. See FIGS. 2 and 5. In the preferred embodiment of the invention, the shoulder straps 62 and 64 are secured to the outside of the bottom wall 16 of the housing 12. Thus, when the person 66 is carrying the portable sink 10, the bottom wall 16 rests against his or her back 68. This is, of course, by way of example as the shoulder straps could be attached elsewhere. As should also be apparent to those skilled in the art, the shoulder straps may be provided with means to adjust the length thereof.

In lieu of legs for supporting the portable camping sink 10 in a vertical position and in lieu of simply placing the sink on a table or similar support surface, the sink of the present invention is intended to be supported on a tree. This is accomplished by the use of a rope or strap 70 or the like that surrounds the trunk 72 of a tree. In its simplest form, the rope 70 has loops 74 and 76 at the ends thereof. After the rope passes around the trunk 72, one loop 74 is passed through the other loop 76 and a carabineer 78 or the like secured to the top wall 14 of the housing 12 is attached to the loop 74. In this way, the rope 70 tightens around the trunk 72 as the camping sink 10 pulls down on the end of the rope 70. After the portable camping sink 10 is suspended from the trunk 72, a strap 78 attached to the rear wall 22 surrounds the trunk 72 to stabilize the sink.

The present invention may be embodied in other specific forms without departing from the spirit or essential attributes thereof and accordingly, reference should be made to the appended claims rather than to the foregoing specification as indicating the scope of the invention.

I claim:

1. A portable camping sink comprising:

a substantially rectangularly shaped housing having a top wall, a bottom wall, a left wall, a right wall, a rear wall and an open front, said housing having a substantially hollow interior;

a sink basin hinged to the front of said bottom wall of said housing, said sink basin being movable between an inoperative position wherein it substantially closes said open front of said housing and an operative position wherein it is at an angle of approximately 90° to the plane of said open front;

means for maintaining said sink basin in said inoperative position when desired;

means for maintaining said sink basin in said operative position when desired;

a water container having a size and shape which allows the same to be inserted into or removed from said housing, said container including a spout that overlies said basin when said container is in said housing and said basin is in its operative position;

at least one side rack hinged to one side of said housing and movable between an inoperative position wherein it overlies said one side of said housing and an operative position wherein it is perpendicular to said one side so as to function as a support rack for utensils, and means for maintaining said at least one side rack in its inoperative and in its operative positions.

2. The portable camping sink as claimed in claim 1 including a second side rack hinged to the other side of said housing and movable between an inoperative position wherein it overlies said second side of said housing and an operative position wherein it is perpendicular to said other side.

3. The portable camping sink as claimed in claim 2 further including means for maintaining said second side rack in its inoperative and in its operative positions.

4. The portable camping sink as claimed in claim 1 further including means for securing said camping sink to the trunk of a tree.

5. The portable camping sink as claimed in claim 1 further including shoulder straps allowing a person to carry said camping sink on his or her back.

6. The portable camping sink as claimed in claim 5 wherein said shoulder straps are arranged so that when said camping sink is being carried, said bottom wall of said housing lies against the person's back.

* * * * *